US007763167B2

(12) United States Patent
Zhang et al.

(10) Patent No.: US 7,763,167 B2
(45) Date of Patent: Jul. 27, 2010

(54) PROCESS FOR DIRECT COAL LIQUEFACTION

(75) Inventors: Yuzhuo Zhang, Beijing (CN); Geping Shu, Beijing (CN); Jialu Jin, Beijing (CN); Minli Cui, Beijing (CN); Xiuzhang Wu, Beijing (CN); Xiangkun Ren, Beijing (CN); Yaowu Xu, Beijing (CN); Shipu Liang, Beijing (CN); Jianwei Huang, Beijing (CN); Ming Yuan, Beijing (CN); Juzhong Gao, Beijing (CN); Yufei Zhu, Beijing (CN)

(73) Assignees: Shenhua Group Corporation Limited, Beijing (CN); China Shenhua Coal Liquefaction Corporation, Beijing (CN)

( * ) Notice: Subject to any disclaimer, the term of this patent is extended or adjusted under 35 U.S.C. 154(b) by 178 days.

(21) Appl. No.: 11/572,638

(22) PCT Filed: Jul. 27, 2005

(86) PCT No.: PCT/CN2005/001132

§ 371 (c)(1),
(2), (4) Date: Sep. 3, 2008

(87) PCT Pub. No.: WO2006/010330

PCT Pub. Date: Feb. 2, 2006

(65) Prior Publication Data

US 2009/0152171 A1 Jun. 18, 2009
US 2009/0283450 A2 Nov. 19, 2009

(30) Foreign Application Priority Data

Jul. 30, 2004 (CN) ..... 2004 1 0070249

(51) Int. Cl.
*C10G 1/06* (2006.01)
*C10G 1/00* (2006.01)

(52) U.S. Cl. ..... 208/412; 208/415; 208/432

(58) Field of Classification Search ..... 208/400, 208/412, 415, 420, 428, 431, 432, 433, 429
See application file for complete search history.

(56) References Cited

U.S. PATENT DOCUMENTS 4,465,584 A * 8/1984 Effron et al. ..... 208/428

(Continued)

FOREIGN PATENT DOCUMENTS

JP 636084 * 1/1988

(Continued)

OTHER PUBLICATIONS

Mochida et al., Progress of coal liquefaction catalysts in Japan, Catalysis Survey from Japan, 1998, Baltzer Science Publishers, pp. 17-30.*

(Continued)

*Primary Examiner*—Walter D Griffin
*Assistant Examiner*—Renee Robinson
(74) *Attorney, Agent, or Firm*—Renner, Otto, Boisselle & Sklar, LLP

(57) ABSTRACT

Process for direct coal liquefaction of coal, including: (1) preparing a coal slurry from raw coal; (2) preheating the coal slurry, then feeding it into reaction system to undergo liquefaction reaction; (3) separating reaction products in a separator to form a liquid phase and a gas phase, wherein the liquid phase is fractionated in an atmospheric tower into a light oil fraction and a bottom product; (4) feeding the atmospheric tower bottom product to a vacuum tower to separate into distillate and vacuum residue; (5) mixing the light oil fraction and the distillate to form a mixture, then feeding the mixture to a suspended bed hydrotreating reactor with forced circulation for hydrogenation; (6) fractionating hydrogenation products into oil products and a hydrogen donor recycling solvent. The process can operate long periods, with higher reactor efficiency and utilization factor, increased liquid oil yield and can supply high-quality feedstock for further processing.

10 Claims, 1 Drawing Sheet

U.S. PATENT DOCUMENTS

| | | | | |
|---|---|---|---|---|
| 4,473,462 | A * | 9/1984 | Swanson | 208/59 |
| 4,792,391 | A * | 12/1988 | Cox | 208/108 |
| 6,190,542 | B1 * | 2/2001 | Comolli et al. | 208/423 |

FOREIGN PATENT DOCUMENTS

| | | |
|---|---|---|
| JP | 10130655 | 5/1998 |
| JP | 10298557 | 11/1998 |

OTHER PUBLICATIONS

Shu ge Ping; "Coal Liquefaction Technology"; Published Oct. 2003. (Translated excerpt).

Shu ge Ping: "Coal Liquefaction Technology"; Published Oct. 2003). (Original in Chinese, pp. 134-135).

* cited by examiner

PROCESS FOR DIRECT COAL LIQUEFACTION

TECHNICAL FIELD

The present invention relates to a process for direct coal liquefaction.

BACKGROUND OF THE INVENTION

In 1913, Dr. Bergius in Germany engaged in the research of producing liquid fuel from coal or coal tar through hydrogenation under high pressure and high temperature, subsequently, he was granted a patent concerning direct coal liquefaction technology, which was the first patent in the field and laid the foundation of direct coal liquefaction. In 1927, the first direct coal liquefaction plant in the world was built in Leuna by a German fuel company (I.G. Farbenindustrie). During World War II, there were altogether 12 such kind of plants built and operated with a total capacity of $423\times10^4$ t/year, which supplied ⅔ of the aviation fuel, 50% of the motor fuel and 50% of the tank fuel for the German Army. The direct coal liquefaction process of that time adopted: bubble type liquefaction reactor, filter or centrifuge for solid-liquid separation, iron containing natural ore catalyst. As the recycling solvent separated from the step of filtration or centrifugation contained less reactive asphaltene together with the low activity of the liquefaction catalyst, the operating conditions of liquefaction reaction were very severe, the operating pressure was about 70 MPa and the operating temperature about 480° C.

After World War II, all of the coal liquefaction plants in Germany were shut down. The early 70's oil crisis compelled the developed countries to pay great attention to searching for oil substitutes, thus many new technologies for direct coal liquefaction were studied and developed.

In the early stages of the 1980's, H-COAL process was developed in the USA. In the H-COAL process, a suspended bed reactor with forced circulation was employed, the operating pressure was about 20 MPa and the operating temperature about 455° C. The catalyst used was Ni—Mo or Co—Mo with $\gamma$-$Al_2O_3$ as carrier, which was the same as the hydrotreating catalyst used in petroleum processing. Recycling solvent was separated by hydrocyclone and vacuum distillation. By virtue of the suspended bed reactor with forced circulation and the hydrotreating catalyst employed in the process, the reaction temperature could be easily controlled and the quality of products stabilized. However, in the coal liquefaction reaction system the hydrotreating catalyst, originally used for petroleum processing, was quickly deactivated, and had to be replaced after a short period of time, which resulted in high cost of the liquid oil products.

The IGOR$^+$ process was developed in the late 1980's in Germany. It employed a bubble type reactor, a vacuum tower to recover the recycle solvent and an on-line fixed bed hydrotreating reactor to hydrogenate both the recycle solvent and the products at different levels. Red mud was used as the catalyst of the process. Since the process employed hydrogenated recycle solvent, coal slurry thus prepared had a stable property and a high coal concentration. Moreover, it could be easily preheated and could exchange heat with gases from the high temperature separator, thus a high heat recovery rate was attained. However, due to the low catalyst activity of the red mud, the operating parameters adopted were still rather severe. The typical operating conditions were as follows: reaction pressure 30 MPa, reaction temperature 470° C. The fixed bed on-line hydrotreating reactor was still at the risk of a short operating cycle due to catalyst deactivation by coking. In addition, the precipitation of calcium salts in the bubble type reactor was unavoidable, if the calcium content of the coal feed was high.

In the late 1990's, the NEDOL process was developed in Japan. In the NEDOL process, a bubble type reactor was also used, the recycle solvent was prepared by vacuum distillation and hydrotreated in an off-line fixed bed hydrogenation reactor, and ultrafine pyrite (0.7μ) was used as liquefaction catalyst. In the process, all recycling hydrogen donor solvent was hydrogenated, thus the coal slurry properties were stable and it could be prepared with a high coal concentration. Moreover, the coal slurry could be easily preheated and could exchange heat with gases from the high temperature separator. Therefore a high heat recovery rate was attained. Additionally, the operation conditions of the process were relatively mild, for example, the typical operating conditions were as follows: reaction pressure 17 MPa, reaction temperature 450° C. However, owing to the hardness of the pyrite ore, it was quite difficult to pulverize into super-fine powder, thus the cost of catalyst preparation was high. For the bubble type reactor, due to its high gas holdup factor, the reactor volume utilization rate was low. Besides, due to a low liquid velocity in the reactor, precipitation of organic minerals might occur, and for the fixed bed hydrotreating reactor employed in the process the risk of short operating cycle still existed.

SUMMARY OF THE INVENTION

The objective of the invention is to provide a direct coal liquefaction process which can be operated steadily for a long period of time with high utilization rate of the reactor volume and the capacity of preventing mineral material sedimentation. Moreover, it is an objective to provide a process which can be operated under mild reaction conditions with maximum yield of liquid products which are of high qualities for further processing.

The process for direct coal liquefaction of the invention comprises the following steps:

(1) preparing a coal slurry from raw coal;

(2) pretreating the coal slurry, then feeding it to a reaction system to undergo liquefaction reaction;

(3) separating reaction effluent in a separator to form a liquid phase and a gas phase, wherein the liquid phase is fractionated in an atmospheric tower into a light oil fraction and a bottom product;

(4) feeding the bottom product to a vacuum tower to separate it into distillate and residue;

(5) mixing the light oil fraction and the distillate to form a mixture, then feeding the mixture to a suspended bed hydrotreating reactor with forced circulation for hydrogenation;

(6) fractionating hydrogenation products into oil products and a hydrogen donor recycling solvent.

In a preferred embodiment of the invention, the coal slurry preparation further comprises the following steps: (a) after being dried and pulverizd in a pretreatment unit, the raw coal is processed into a coal powder with designated particle size; (b) the coal powder and a catalyst feedstock are processed in the catalyst preparation unit to prepare a superfine coal liquefaction catalyst; (c) the coal liquefaction catalyst and the coal powder are mixed with the hydrogen-donor solvent to form a coal slurry in a slurry preparation unit.

According to the process of the invention, the liquefaction reaction of coal comprises the following steps: (a) after mixing with hydrogen and preheating, the coal slurry enters into a first suspended bed reactor with forced circulation to undergo liquefaction reaction to get an outlet effluent; (b) the outlet effluent from the first suspended bed reactor after mixing with make-up hydrogen enters into a second suspended bed reactor with forced circulation to undergo further liquefaction reaction, wherein the aforesaid liquefaction reaction conditions are as follows:

reaction temperature: 430-465° C.;

reaction pressure: 15-19 MPa;

gas/liquid ratio: 600-1000 NL/kg (NL=liters at 1 atm. and 0° C.);

space velocity of coal slurry: 0.7-1.0 $t/m^3 \cdot h$;

catalyst addition rate: Fe/dry coal=0.5-1.0 wt %.

According to the process, the gas liquid separation of step (3) further comprises the following steps: (a) the reaction effluent is sent to a high temperature separator to separate into a gas phase and a liquid phase, wherein, the temperature of the high temperature separator is controlled at 420° C.; (b) the gas phase from the high temperature separator is sent to a low temperature separator for further separation into gas and liquid, wherein the low temperature separator is kept at room temperature.

According to a preferred embodiment of the invention, the particle size of the liquefaction catalyst (γ-FeOOH) has a diameter of 20-30 Nm, and a length of 100-180 Nm; S is contained in the catalyst and the mole ratio of S/Fe=2.

According to the process, the hydrotreating operating conditions in step (5) are as follows:

reaction temperature: 330-390° C.;

reaction pressure: 10-15 MPa;

gas/liquid ratio: 600-1000 NL/kg;

space velocity: 0.8-2.5 $h^{-1}$.

The aforesaid hydrogen donor solvent is derived from hydrogenated liquefaction oil product, with a boiling range of 220-450° C.

The vacuum residue has a solid content of 50-55 wt %.

The boiling range of the mixture of the light oil fraction from the atmospheric tower and the vacuum tower distillates is C5-530° C.

Moreover, the suspended bed hydrotreating reactor with forced circulation is equipped with internals and a circulation pump is equipped adjacent to the bottom of the reactor. The catalyst in the reactor can be replaced in operation.

The present invention provides a direct coal liquefaction process with the following features: the liquefaction catalyst adopted is of high activity; hydrogen donor recycling solvent, suspended bed reactor with forced circulation and suspended bed hydrotreating reactor with forced circulation are adopted in the process; asphaltene and solid are separated out by vacuum distillation. Therefore, stable and long term operation and a high utilization rate of reactor volume can be achieved in the inventive process. In addition, the inventive process can be operated under mild reaction conditions, effectively preventing mineral material sedimentation, and the objectives of maximization of liquid oil yield and provision of high quality feedstock for further processing can be attained simultaneously.

DESCRIPTION OF DRAWING

Referring to the attached drawing FIGURE, it is easier to understand the technical solution of the invention.

DETAILED DESCRIPTION OF THE INVENTION

Figure 1:
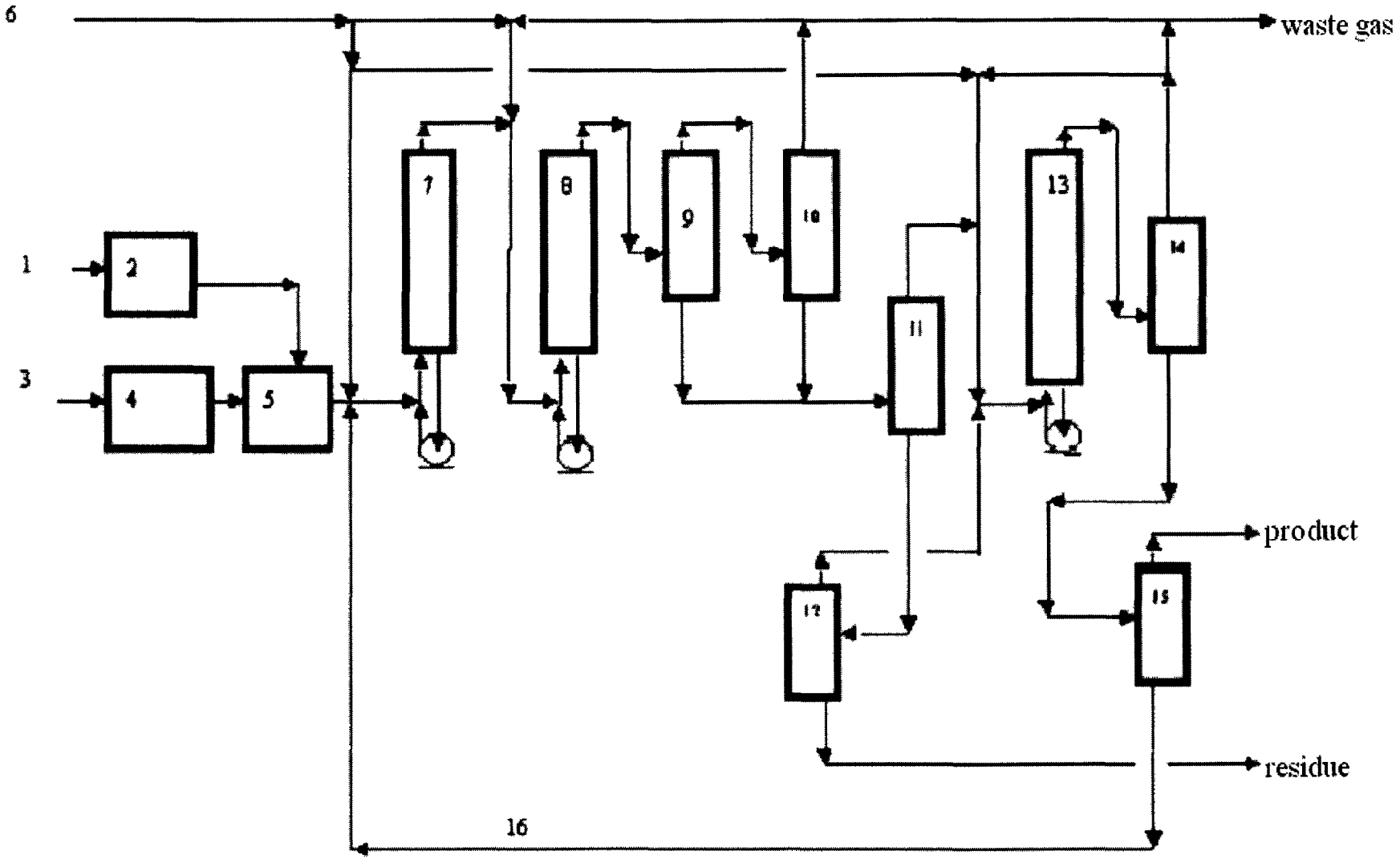
FIG. 1 is a flow chart of an embodiment of the invention.

The reference numerals presented in FIG. 1 represent respectively: 1. Raw coal feed; 2. Coal pretreatment unit; 3. Catalyst feedstock; 4. Catalyst preparation unit; 5. Slurry preparation unit; 6. Hydrogen; 7. First suspended bed reactor with forced circulation; 8. Second suspended bed reactor with forced circulation; 9. High temperature separator; 10. Low temperature separator; 11. Atmospheric fractionator; 12. Vacuum fractionator; 13. Suspended bed hydrotreating reactor with forced circulation; 14. Gas-liquid separator; 15. Product fractionator; 16. Hydrogen donor solvent.

Referring to FIG. 1, raw coal feed 1 is dried and pulverized in the coal pretreating unit 2 to form a coal powder with a designated particle size. Catalyst feedstock 3 is processed to prepare the required catalyst with superfine particles in catalyst preparation unit 4. The coal powder and the catalyst together with the hydrogen donor solvent 16 are mixed to form the coal slurry in the coal slurry preparation unit 5. The coal slurry and hydrogen 6 after mixing and preheating enter into the first suspended bed reactor 7 with forced circulation. The outlet effluent from the first reactor after mixing with the make-up hydrogen enters into the second suspended bed reactor 8 with forced circulation. The reaction effluent from the second reactor 8 enters into the high temperature separator 9 and is separated into gas and liquid. The temperature of the high temperature separator 9 is controlled at 420° C. The gas phase from the high temperature separator 9 enters into the low temperature separator 10 to further separate into gas and liquid, wherein the low temperature separator is operated at room temperature. The gas from the low temperature separator 10 is mixed with hydrogen and recycled for reuse, while the waste gas is discharged from the system. The liquids from both the high temperature separator 9 and the low temperature separator 10 enter into the atmospheric tower 11 to separate out the light fractions. The tower bottom is sent to the vacuum tower 12 to remove asphaltene and solids. The vacuum tower bottom is the so-called vacuum residue. In order to discharge the bottom residue freely under certain temperature, generally the solid content of the residue is controlled at 50-55 wt %. The distillates from both the atmospheric tower 11 and vacuum tower 12 after mixing with hydrogen 6 are sent into the suspended bed hydrotreating reactor 13 with forced circulation to upgrade the hydrogen donor property of the solvent through hydrogenation. Because of the high content of polynuclear aromatics and heterogeneous atoms and the complexity in structure of the coal liquid oil, the liquefaction catalyst is deactivated easily by coking. By using the suspended bed hydrotreating reactor with forced circulation, the catalyst can be displaced periodically and the on-stream time can be prolonged indefinitely, the risk of pressure drop increase due to coking can be avoided. The outlet material from the suspended bed hydrotreating reactor 13 with forced circulation enters into the separator 14 to separate into gas and liquid. The gas phase from separator 14 after mixing with hydrogen is recycled and the waste gas is discharged from the system. The liquid phase from separator 14 enters into the product fractionator 15, in which products and hydrogen donor solvent are separated out. Gasoline and diesel distillates are the final products.

The aforesaid coal powder is either brown coal or low rank bituminous coal with water content of 0.5-4.0 wt %, and particle size ≦0.15 mm.

In the process, the catalyst used is superfine γ-FeOOH, with a diameter of 20-30 Nm (nanometer) and a length of 100-180 Nm. Sulfur is added simultaneously, at a molar ratio of S/Fe=2. Because of the high activity of the catalyst, its addition rate is low, Fe/dry coal=0.5-1.0 wt %, the conversion rate of coal of the process is high. Since there is less oil carried out by the catalyst contained in the residue, oil yield can be increased correspondingly.

The hydrogen donor recycling solvent in the process comes from hydrogenated coal liquid oil with a boiling range of 220-450° C. Since the solvent is hydrogenated, it is quite stable and easy to form a slurry with high coal concentration (45-55 wt %), good fluidity and low viscosity (<400 CP at 60° C.). By the hydrogenation, the solvent has a very good hydrogen donor property. In addition, the use of highly active liquefaction catalyst results in mild reaction conditions, such as reaction pressure 17-19 MP, and reaction temperature 440-465° C. Since the recycling solvent is hydrotreated, it possesses a very good hydrogen donor property and can prevent condensation of free radical fragments during pyrolysis of coal, and therefore coke formation is avoided, the operating cycle prolonged and simultaneously the heat utilization rate increased.

In the process, the use of the suspended bed reactor with forced circulation results in low gas holdup and high utilization rate of reactor liquid volume. Moreover, owing to the application of a forced circulation pump, high liquid velocity is maintained and no precipitation of mineral salts will occur. According to a preferred embodiment of the invention, two suspended reactors with forced circulation are adopted. Due to reactant back mixing within the two reactors, the axial temperature profiles of the reactors can be quite uniform, and the reaction temperature can be easily controlled with no need to use quenching hydrogen injected from reactor side streams. Also, the product qualities of the process are quite stable. Because of the low gas holdup of the suspended bed reactor with forced circulation, the reactor liquid volume utilization rate is high. Due to its high liquid velocity, there will be no deposits of mineral salts in the reactor.

According to another preferred embodiment of the invention, asphaltene and solids can be effectively removed through vacuum distillation. Vacuum distillation is a mature and effective method to remove asphaltene and solids. Vacuum distillate does not contain asphaltene and can be a qualified feedstock for preparing recycling solvent with high hydrogen donating property after hydrogenation. The vacuum residue has a solid content of 50-55 wt %. Since the employed catalyst is of high activity, the catalyst addition rate of the process is low, the oil content of the residue is also low and more the diesel fractions can be obtained.

According to another preferred embodiment of the invention, the recycling solvent and oil products are hydrogenated in a suspended bed hydrotreating reactor with forced circulation. Since the hydrotreating reactor belongs to the up-flow type reactor, the catalyst in the reactor can be replaced periodically, which will lead to a good hydrogen donating property of the recycling solvent after hydrogenation and to stable product qualities. Moreover, the operating cycle can be prolonged indefinitely and the risk of pressure drop build-up due to coking can be eliminated.

According to a preferred embodiment of the invention, a test of direct coal liquefaction is performed using a low rank bituminous coal as feedstock, and the operation conditions and test results are as follows:

Test operation conditions:

Reactor temperature: $1^{st}$ reactor 455° C., $2^{nd}$ reactor 455° C.;

Reactor pressure: 1st reactor 19.0 MPa, $2^{nd}$ reactor 19.0 MPa;

Slurry coal concentration: 45/55 (dry coal/solvent, mass ratio);

Catalyst addition rate: Liquefaction catalyst: 1.0 wt % (Fe/dry coal);

Sulfur addition rate: molar ratio of S/Fe=2;

Gas/liquid: 1000 NL/Kg slurry;

Hydrogen in the recycle gas: 85 vol %.

The results of direct coal liquefaction of a low rank bituminous coal in a CFU test unit of the invention are shown in Table 1, wherein the figures in the table are based on MAF coal. The results of the same kind of coal tested in another direct coal liquefaction CFU is shown in Table 2, wherein the figures in table 2 are also based on MAF coal.

TABLE 1

Direct coal liquefaction results of a low rank bituminous coal in a CFU unit

| | Conversion % | Oil yield % | Gas yield % | $H_2O$ yield % | Organic residue % | $H_2$ consumption % |
|---|---|---|---|---|---|---|
| Process of the invention | 91.22 | 57.17 | 13.11 | 12.51 | 23.99 | 6.8 |

TABLE 2

Direct coal liquefaction results of a low rank bituminous coal in a CFU unit

| | Conversion % | Oil yield % | Gas yield % | $H_2O$ yield % | Organic residue % | $H_2$ consumption % |
|---|---|---|---|---|---|---|
| Process of the prior art | 89.69 | 52.84 | 17.89 | 7.3 | 28.1 | 6.75 |

By comparison of Table 1 and Table 2, it is clear that both the conversion rate and oil yield of the invention is higher than that of the prior art. A lower organic residue yield and a better liquefaction effect can also be achieved.

What is claimed is:

1. A direct coal liquefaction process, wherein the process comprises the following steps:

(1) preparing a coal slurry from raw coal, by drying and pulverizing raw coal in a pretreating unit; processing the raw coal into a coal powder with designated particle size; preparing a superfine coal liquefaction catalyst from a catalyst feedstock and the coal powder in a catalyst preparation unit; mixing the coal liquefaction catalyst and additional coal powder with a hydrogen-donor solvent to form the coal slurry in a slurry preparation unit;

(2) pretreating the coal slurry, by mixing together and preheating the coal slurry and hydrogen and after the preheating passing the mixture of coal slurry and hydrogen into a first suspended bed reactor with forced circulation to undergo liquefaction reaction to form an outlet effluent; mixing the outlet effluent from the first suspended bed reactor with make-up hydrogen and then passing the mixture of the outlet effluent and make-up hydrogen into a second suspended bed reactor with forced circulation to undergo further liquefaction reaction;

(3) separating reaction effluent from the second suspended bed reactor in a separator to form a liquid phase and a gas phase, wherein the liquid phase is fractionated in an atmospheric tower into a light oil fraction and a bottom product;

(4) feeding the atmospheric tower bottom product to a vacuum tower to separate it into distillate and residue;

(5) mixing the light oil fraction and the distillate to form a mixture, then feeding the mixture to a suspended bed hydrotreating reactor with forced circulation for hydrogenation;

(6) fractionating hydrogenation products into oil products and a hydrogen donor recycling solvent.

2. The process according to claim 1, (c) wherein the coal liquefaction catalyst is γ-FeOOH .

3. The process according to claim 2, wherein, the suspended bed reactors are operated at the following conditions:

reaction temperature: 430-465° C.;

reaction pressure: 15-19 MPa;

gas/liquid ratio: 600-1000 NL/Kg;

slurry space velocity: 0.7-1.0 $t/m^3 \cdot h$;

catalyst addition rate: Fe/Dry coal=0.5-1.0 wt %.

4. The process according to claim 1, wherein step (3) comprises the following steps:

(a) sending the reaction effluent to a high temperature separator to separate into a gas phase and a liquid phase, wherein the temperature of the high temperature separator is controlled at 420° C.;

(b) sending the gas phase from the high temperature separator to a low temperature separator for further separation into gas and liquid, wherein the temperature of the low temperature separator is controlled at room temperature.

5. The process according to claim 2, wherein the liquefaction catalyst has a diameter of 20-30 Nm, length of 100-180 Nm; sulfur is contained in the catalyst with a molar ratio of S/Fe=2.

6. The process according to claim 1, wherein the reaction conditions of hydrogenation in step (5) are as follows:

reaction temperature: 330-390° C.;

reaction pressure: 10-15 MPa;

gas/liquid ratio: 600-1000 NL/Kg;

space velocity: 0.8-2.5 $h^{-1}$.

7. The process according to claim 1, wherein the recycling hydrogen donor solvent is a hydrogenated liquefied oil product with a boiling range of 220-450° C.

8. The process according to claim 1, wherein the residue from the vacuum tower has a solids content of 50-55 wt %.

9. The process according to claim 1, wherein the mixture of the light oil fraction from the atmospheric tower and the vacuum distillate has a boiling range of C5-530° C.

10. The process according to claim 1, wherein the suspended bed hydrotreating reactor with forced circulation is a reactor equipped with internals, a circulating pump is equipped adjacent to the bottom of the reactor and the catalyst in the reactor can be replaced in operation.

* * * * *

UNITED STATES PATENT AND TRADEMARK OFFICE

CERTIFICATE OF CORRECTION

PATENT NO. : 7,763,167 B2
APPLICATION NO. : 11/572638
DATED : July 27, 2010
INVENTOR(S) : Zhang et al.

It is certified that error appears in the above-identified patent and that said Letters Patent is hereby corrected as shown below:

Claim 2, line 2, delete "(c)"

Signed and Sealed this

Second Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,763,167 B2
APPLICATION NO. : 11/572638
DATED : July 27, 2010
INVENTOR(S) : Zhang et al.

It is certified that error appears in the above-identified patent and that said Letters Patent is hereby corrected as shown below:

Column 7, line 8, Claim 2, line 2, delete "(c)"

This certificate supersedes the Certificate of Correction issued November 2, 2010.

Signed and Sealed this

Seventh Day of December, 2010

David J. Kappos

David J. Kappos
*Director of the United States Patent and Trademark Office*